US011565367B2

(12) United States Patent
Roberts et al.

(10) Patent No.: US 11,565,367 B2
(45) Date of Patent: Jan. 31, 2023

(54) RETAINING RING

(71) Applicant: Applied Materials, inc., Santa Clara, CA (US)

(72) Inventors: Liam S. Roberts, Portland, OR (US); Eric A. Bunn, Banks, OR (US)

(73) Assignee: Applied Materials, Inc., Santa Clara, CA (US)

( * ) Notice: Subject to any disclaimer, the term of this patent is extended or adjusted under 35 U.S.C. 154(b) by 184 days.

(21) Appl. No.: 16/924,355

(22) Filed: Jul. 9, 2020

(65) Prior Publication Data

US 2022/0009052 A1 Jan. 13, 2022

(51) Int. Cl.
*B24B 37/32* (2012.01)
*B24B 37/20* (2012.01)

(52) U.S. Cl.
CPC ..... *B24B 37/32* (2013.01); *B24B 37/20* (2013.01)

(58) Field of Classification Search
CPC ..... B24B 37/32; B24B 53/02; B24B 37/30; B24B 37/10; B24B 37/105; B24B 37/107; B24B 41/007; B24B 47/061; B24B 47/00; B24B 47/10; B24B 47/12; B24B 49/16
USPC ..... 451/285, 288, 397, 398
See application file for complete search history.

(56) References Cited

U.S. PATENT DOCUMENTS

| | | | | |
|---|---|---|---|---|
| 7,094,139 | B2 * | 8/2006 | Marohl | B24B 37/32 451/442 |
| 7,160,493 | B2 | 1/2007 | Willis et al. | |
| 7,210,991 | B1 | 5/2007 | Van Der Veen et al. | |
| 7,344,434 | B2 * | 3/2008 | Chen | B24B 37/32 451/285 |
| 7,857,683 | B2 * | 12/2010 | Burns | B24B 37/32 451/286 |
| 8,517,803 | B2 * | 8/2013 | Sather | B24B 37/32 451/286 |
| 9,005,499 | B2 * | 4/2015 | Lee | B24B 37/32 264/138 |
| 10,500,695 | B2 * | 12/2019 | Reedy | H01L 21/68721 |
| 11,088,011 | B2 * | 8/2021 | Yamaki | B24B 7/04 |

* cited by examiner

*Primary Examiner* — Joel D Crandall
*Assistant Examiner* — Robert F Neibaur
(74) *Attorney, Agent, or Firm* — Patterson + Sheridan, LLP

(57) ABSTRACT

A retaining ring used in the polishing of semiconductor substrates is described herein. A retaining ring includes a bottom surface configured to contact a polishing pad and a top surface configured to attach to a carrier head. The top surface includes a plurality of screw holes and a plurality of alignment slots. The top surface also includes a first insert disposed in a first alignment slot of the plurality of alignment slots, the first insert flush with or below the top surface, and where the first insert configured to prevent insertion of an alignment pin into the first alignment slot.

20 Claims, 6 Drawing Sheets

RETAINING RING

BACKGROUND

Field

Embodiments of the present disclosure generally relate to an apparatus and method for polishing and/or planarization of semiconductor substrates. More particularly, embodiments of the disclosure relate to retaining rings for carrier heads utilized for chemical mechanical polishing (CMP).

Description of the Related Art

During fabrication of a semiconductor device, various layers such as oxides and copper for example, require polishing to remove steps or undulations before formation of subsequent layers. Polishing is useful in removing undesired surface topography and surface defects, such as rough surfaces, agglomerated materials, crystal lattice damage, scratches, and contaminated layers or materials. Polishing is also useful in forming features on a substrate by removing excess deposited material used to fill the features and to provide an even surface for subsequent levels of metallization and processing.

Polishing is typically performed mechanically, chemically, and/or electrically using processes such as chemical mechanical polishing (CMP) or electro-chemical mechanical polishing (ECMP).

CMP removes material from the surface of a substrate in the presence of a slurry through a combination of mechanical and chemical interaction. During CMP, the slurry is delivered on to a rotating polishing pad, and the substrate is pressed against the polishing pad by a carrier head. The carrier head may also rotate and move the substrate relative to the polishing pad. As a result of the motion between the carrier head and the polishing pad and chemicals included in the slurry, substrate surface is planarized.

A retaining ring is secured to the carrier head to retain the semiconductor substrate and improve the resulting finish and flatness of the substrate surface. The retaining ring has a bottom surface for contacting the polishing pad during polishing and a top surface which is secured to the carrier head. While top surfaces of different retaining rings are identical to each other in order to facilitate attachment to the same carrier head, bottom surfaces can differ in terms of materials, groove design, and other aspects. The bottom surface can wear down during operation from contact with the polishing pad and therefore requires periodic replacement. Because retaining rings have different bottom surfaces, an important aspect of CMP maintenance is that the correct retaining ring be installed on the carrier head during building, rebuilding, and/or refurbishment.

In that regard, a quality control issue exists whereby incorrect retaining rings are installed on carrier heads, which can risk manufacturing quality of thousands of substrates, and/or resulting in substrate scrap. Currently, this issue is addressed using visual checks when building or rebuilding carrier heads and/or before installing carrier heads onto CMP tools. However, retaining rings visually look the same, the only difference being product numbers stamped inside the retaining rings, which are not visible once the retaining rings are installed on the carrier heads. Thus, mounting the correct retaining ring to a carrier head is highly dependent on the attentiveness and diligence of the service technician.

Therefore, there is a need for an apparatus and method to avoid the foregoing quality control issues.

SUMMARY

Embodiments of the present disclosure generally relate to retaining rings for carrier heads utilized for chemical mechanical polishing (CMP).

In one or more embodiments, a retaining ring includes a bottom surface configured to contact a polishing pad and a top surface configured to attach to a carrier head. The top surface includes a plurality of screw holes, a plurality of alignment slots, and a first insert disposed in a first alignment slot of the plurality of alignment slots. The first insert is flush with or below the top surface and the first insert is configured to prevent insertion of an alignment pin into the first alignment slot.

In one or more embodiments, a polishing system includes a retaining ring and a carrier head. The carrier head has a bottom surface contacting the top surface of the retaining ring, and the carrier head includes at least one alignment pin extending from the bottom surface into an open one of the plurality of alignment slots.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Before describing several exemplary embodiments of the apparatus and methods, it is to be understood that the disclosure is not limited to the details of construction or process steps set forth in the following description. It is envisioned that some embodiments of the present disclosure may be combined with other embodiments.

One or more embodiments of the present disclosure are directed towards a retaining ring configured to selectively mate with a carrier head for chemical mechanical polishing (CMP). The present disclosure generally provides techniques for ensuring only a predetermined retaining ring can be mated with a carrier head having a complimentary mating features. The mating features of a particular combination of retaining ring and carrier head is selected to be utilized to perform a predefined CMP process on the polishing system, whereas a retaining ring configured to perform a different CMP process cannot be mated to the carrier head. The selective mating significantly reduces the human error component, thus substantially preventing incorrect retaining rings from being installed on CMP carrier heads, which can eliminate substrate scrap caused by using an incorrect retaining ring.

The present disclosure provides a retaining ring used in the polishing of semiconductor substrates. A retaining ring includes a bottom surface configured to contact a polishing pad and a top surface configured to attach to a carrier head. The top surface of the retaining ring includes a plurality of screw holes and a plurality of alignment slots. A surface of the carrier head receiving the top surface of the retaining ring includes at least one alignment pin. The one or more alignment pins of the carrier head have a size and arrangement that defines a mating feature that is complimentary to (i.e., mates with) open ones of the plurality of alignment slots. At least one alignment slot has an insert that prevents insertion of an alignment pin, while least one alignment slot is open to allow insertion of the alignment pin, thus making the open alignment slot(s) a complimentary mating feature of the alignment pin(s) extending from the carrier head. Thus, a unique selection of a predefined mating pattern of complimentary open alignment slot(s) and alignment pin(s) limits the mounting of only a specific retaining ring to a specific carrier head, thus substantially preventing inadvertent mounting of similarly sized retaining rings to the carrier head.

The present disclosure also provides a polishing system. The polishing system includes the retaining ring and carrier head as described above.

Figure 1:
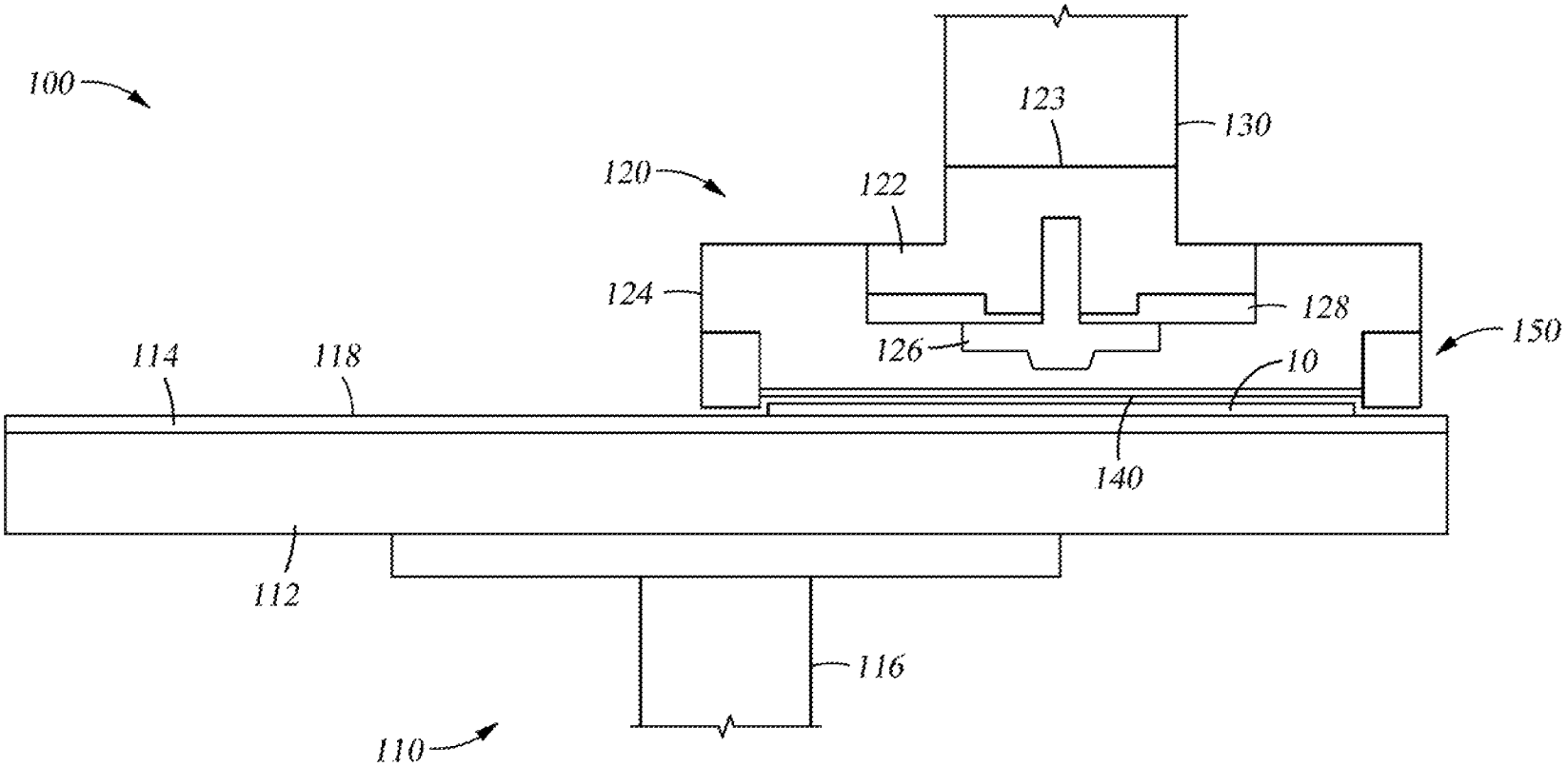
FIG. 1 is a side partial sectional view of a polishing system according to one embodiment.

FIG. 1 is a side partial sectional view of a polishing system 100 according to one embodiment. Polishing systems that may be adapted to benefit from the present disclosure include MIRRA®, MIRRA MESA®, REFLEXION®, and REFLEXION® LK Planarizing Systems, all available from Applied Materials, Inc. of Santa Clara, Calif., among others.

The polishing system 100 generally comprises a polishing station 110, a carrier head 120, and a retaining ring 150. In at least one embodiment, the polishing system 100 has a single polishing station 110. In another embodiment, the polishing system 100 includes multiple polishing stations 110 and multiple carrier heads 120. For example, the polishing station 110 may be disposed on a system base having multiple platens and the carrier head 120 may be supported by a rotatable carousel having multiple carrier heads identical or similar to the carrier head 120. In some embodiments, the carrier head 120 may move a substrate 10 from one polishing station 110 to another polishing station configured to perform a different polishing step to the substrate 10. In some embodiments, one or more carrier heads 120 may be configured to perform a single predefined CMP process, so that only one type of retaining ring 150 may be mated to the carrier heads 120 for that process, such that the wrong retaining ring cannot be installed.

The polishing station 110 generally comprises a rotatable platen 112 on which a polishing pad 114 is placed. The rotatable platen 112 and the polishing pad 114 are generally larger than a semiconductor substrate 10 being processed. In at least one embodiment, the platen 112 is a rotatable aluminum or stainless steel plate connected by a stainless steel drive shaft 116 to a platen drive motor (not shown), which rotates the platen 120 and polishing pad 114 during processing.

The polishing pad 114 has a roughened polishing surface 118 configured to polish the substrate 10. In at least one embodiment, the polishing pad 114 may be attached to the platen 112 by a pressure-sensitive adhesive layer. The polishing pad 114 is generally consumable and may be replaced.

The polishing station 110 may further comprise a polishing composition supply tube (not shown) configured to provide a polishing composition (e.g., slurry) to the polishing pad 114. The polishing composition generally contains a reactive agent, e.g. deionized water for oxide polishing, abrasive particles, e.g., silicon dioxide for oxide polishing, and a chemical-reactive catalyzer, e.g., potassium hydroxide for oxide polishing.

The polishing station 110 may further comprise a pad conditioner (not shown) configured to maintain the polishing pad 114 in a state that effectively polishes the substrate 10. In at least one embodiment, the pad conditioner may comprise a rotatable arm holding an independently rotating conditioner head.

The carrier head 120 is generally configured to press the substrate 10 against the polishing pad 114 during polishing. In one example, the carrier head 120 includes a housing 122, a base assembly 124, a gimbal 126, and a loading chamber 128.

The housing 122 is generally circular in shape and can be connected to a spindle 130 to rotate and/or sweep then carrier head 120 across the polishing pad 114 during polishing. The base assembly 124 is a vertically movable assembly located beneath the housing 122. The gimbal 126 slides vertically to provide a vertical motion of the base assembly 124. The gimbal 126 also permits the base assembly 124 to pivot with respect to the housing 122 so that the retaining ring 150 may remain substantially parallel with the polishing surface 118 of the polishing pad 114.

The loading chamber 128 is located between the housing 122 and the base assembly 124 to apply a load (i.e., a downward pressure) to the base assembly 124. The vertical position of the base assembly 124 relative to the polishing pad 114 is also controlled by the loading chamber 128.

Figure 2A:
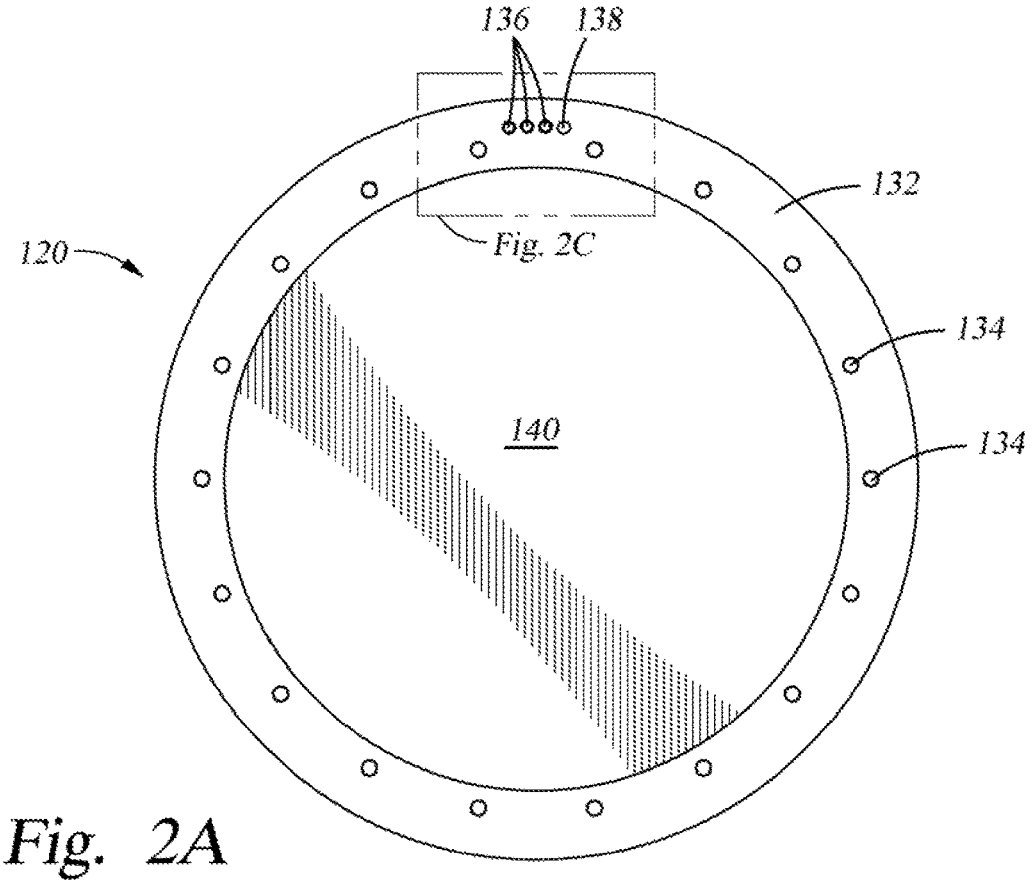
FIG. 2A is a bottom view of one embodiment of a carrier head that may be used in the polishing system of FIG. 1.

FIG. 2A is a bottom view of one embodiment of the carrier head 120 that may be used in the polishing system 100 of FIG. 1. The base assembly 124 of the carrier head 120 includes a bottom surface 132 having a plurality of thru-holes 134 for receiving a plurality of fasteners (e.g., machine screws) to attach the retaining ring 150 to the carrier head 120. In FIG. 2A, the carrier head 120 has 18 thru-holes, such that the thru-holes 134 are evenly spaced by a radial angle of 20 degrees. In some other embodiments, the carrier head 120 may have a lower or higher number of thru-holes 134, and the thru-holes 134 may have uniform or non-uniform spacing.

The carrier head 120 also includes a plurality of alignment pins 136 extending from the bottom surface 132. Generally, at least two alignment pins 136 extend from the bottom surface 132. The alignment pins 136 may have a circular, polygonal or other profile. The alignment pins 136 may be oriented vertically, that is, the alignment pins 136 may be oriented parallel with a centerline of the carrier head 120. The centerline of the carrier head 120 being the axis upon which the carrier head 120 is rotated during processing. In some embodiments, the alignment pins 136 may be oriented non-vertically. In at least one embodiment, each of the alignment pins 136 has a radial orientation relative to the centerline of the carrier head 120. In some embodiments, each alignment pin 136 may be press-fit into a respective aperture 138 formed in the bottom surface 132. The aperture 138 may be a hole, recess or other pin receiving geometric shape. In some embodiments, the alignment pins 136 may be threaded in respective apertures 138 or attached to the base assembly 124 by another suitable technique. In some embodiments, the alignment pins 136 may be attached to the base assembly 124 without using an aperture 138, such as by machining, brazing, welding, or by another suitable technique. In some embodiments, a combination of alignment pins 136 can vary between carrier heads 120 so that each carrier head 120 can only attach to a uniquely configured retaining ring 150 which is keyed for that particular carrier head 120.

The carrier head 120 also comprises a membrane 140 that contacts the substrate 10. Pressure applied to a chamber bounded by the backside of the membrane 140 may be selected to control the center to edge profile of force applied by the membrane 140 to the substrate 10, and consequently, to control the center to edge profile of force applied by the substrate 10 against the polishing pad 114.

Figure 2B:
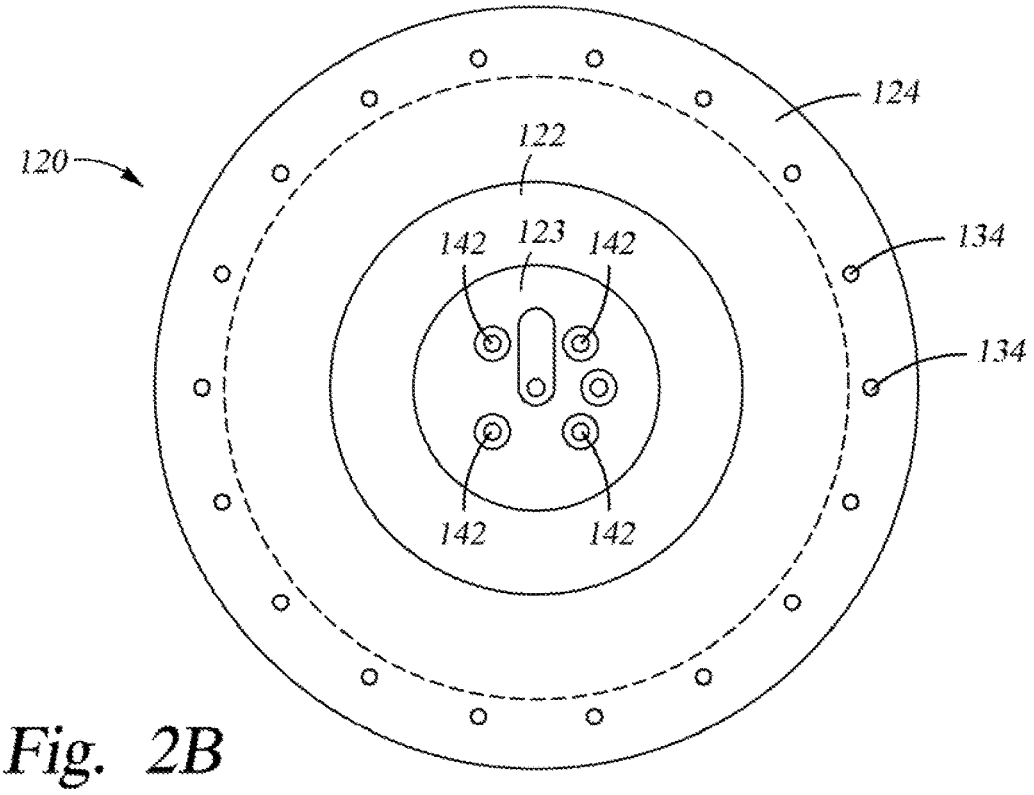
FIG. 2B is a top view of one embodiment of a carrier head that may be used in the polishing system of FIG. 1.

FIG. 2B is a top view of one embodiment of a carrier head 120 that may be used in the polishing system 100 of FIG. 1. The carrier head 120 comprises a plurality of pneumatic ports 142 for supplying pressurized air to respective chambers of the carrier head 120. The pressure within the chambers are utilized to control the pressure applied to the membrane 140, move the base assembly 124, and to displace the retaining ring 150.

Figure 2C:
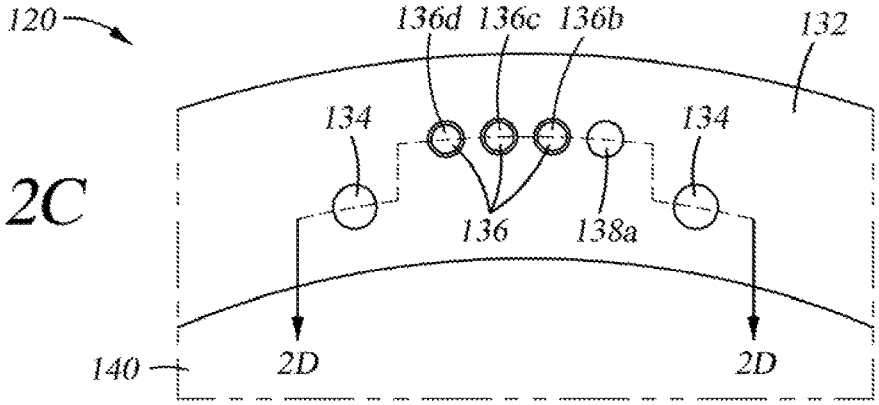
FIG. 2C is an enlarged view of the carrier head of FIG. 2A showing one embodiment of alignment pins.

FIG. 2C is an enlarged view of the carrier head 120 of FIG. 2A showing one arrangement of alignment pins 136. In FIG. 2C, the carrier head 120 comprises a first open aperture 138*a* without an alignment pin 136, that is, there is no pin in the open aperture. Thus, a number of apertures 138 are greater than a number of alignment pins 136. In some other embodiments, each aperture 138 is occupied by a respective pin 136.

The carrier head 120 generally includes at least one alignment pin 136. In the example depicted in FIG. 2C, the alignment pins 138 of the carrier head 120 are shown as a first alignment pin 136*b* at least partially disposed in a second aperture 138*b*, a second alignment pin 136*c* at least partially disposed in a third aperture 138*c*, and a third alignment pin 136*d* at least partially disposed in a fourth aperture 138*d*. In at least one embodiment, the alignment pins 136 and/or apertures 138 may be evenly spaced. In some other embodiments, the carrier head 120 may have a lower or higher number of alignment pins 136 and/or apertures 138, and the alignment pins 136 and/or apertures 138 may have uniform or non-uniform spacing. In some embodiments, the alignment pins 136 and/or apertures 138 may be circular, obround, oval, triangular, square, any other suitable shape, or combinations thereof. In some embodiments, the apertures 138 may be formed by drilling, machining or other suitable technique. In some embodiments, the alignment pins 136 and/or apertures 138 may be grouped between adjacent thru-holes 134. In at least one embodiment, the alignment pins 136 and/or apertures 138 may be grouped within a radial angle of about 20 degrees or less, such as from about 10 degrees to about 20 degrees. In at least one embodiment, the alignment pins 136 and/or apertures 138 may be grouped within a linear distance of about 50 mm or less, such as from about 25 mm to about 50 mm. In one example, the apertures 138 are disposed on a common radius. In another example, a first group of the apertures 138 disposed on a first common radius, and a second group of the apertures 138 disposed on a second common radius.

Figure 2D:
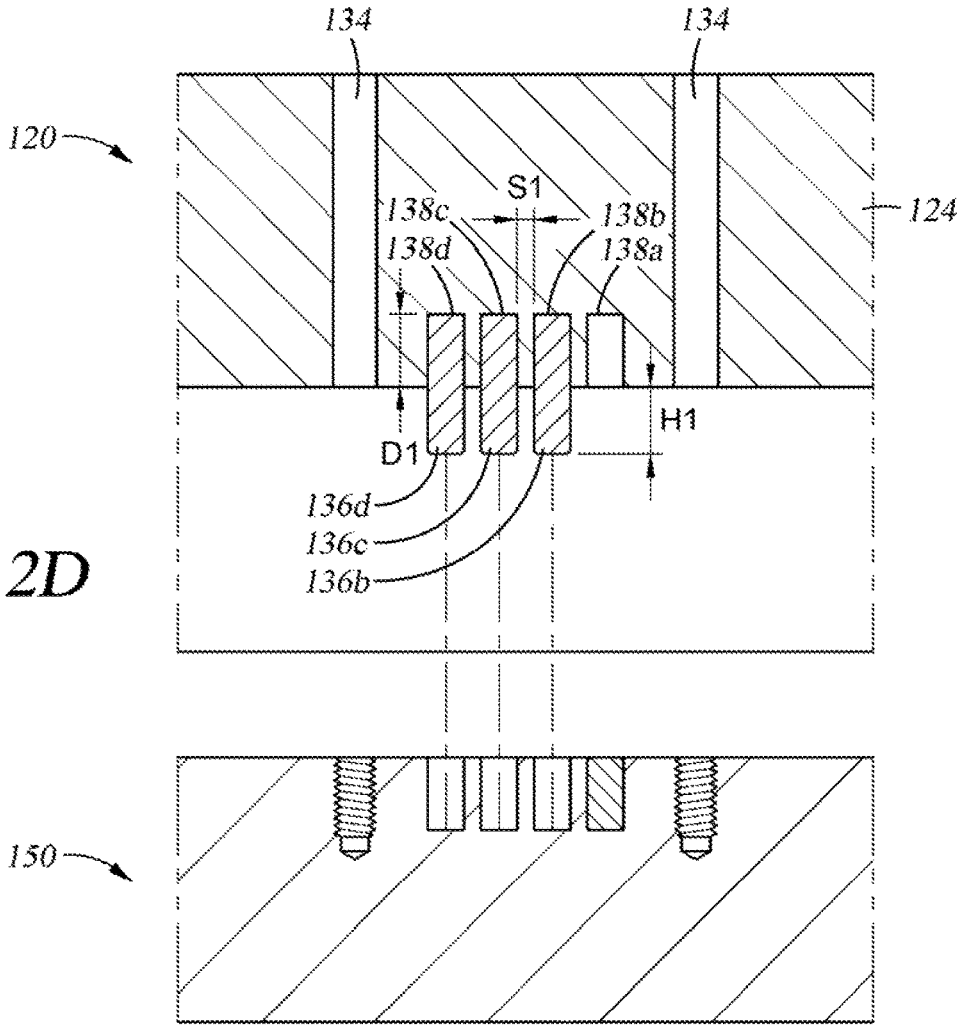
FIG. 2D is a sectional view taken along section line 2D-2D of FIG. 2C showing one embodiment of alignment pins.

FIG. 2D is a section view along line 2D-2D of FIG. 2C showing one embodiment of alignment pins 136. The alignment pins 136 may extend from the bottom surface 132 by a distance H1 of about 10 mm or less, such as from about 2 mm to about 10 mm, such as from about 4 mm to about 6 mm. Adjacent alignment pins 136, such as first and second alignment pins 136*b-c*, may be spaced by a distance S1 of about 2 mm or more, such as from about 2 mm to about 10 mm, such as from about 4 mm to about 5 mm. The apertures 138 may have a depth D1 of about 4 mm or more, such as from about 4 mm to about 20 mm, such as from about 8 mm to about 12 mm. The apertures 138 may have a diameter configured to provide a press-fit of the alignment pins 136 into the apertures 138.

Figure 2E:
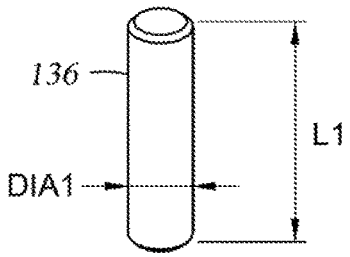
FIG. 2E is a perspective view of one embodiment of an alignment pin that may be used in the carrier head of FIG. 2A.

FIG. 2E is a perspective view of one embodiment of an alignment pin 136 that may be used in the carrier head 120 of FIG. 2A. The alignment pin 136 may have a length L1 of about 2 mm to about 30 mm, such as from about 2 mm to about 10 mm, such as from about 4 mm to about 6 mm, alternatively from about 6 mm to about 30 mm, such as from about 10 mm to about 22 mm. The alignment pin 136 may have a diameter DIA1 of from about 3 mm to about 6 mm.

Figure 3A:
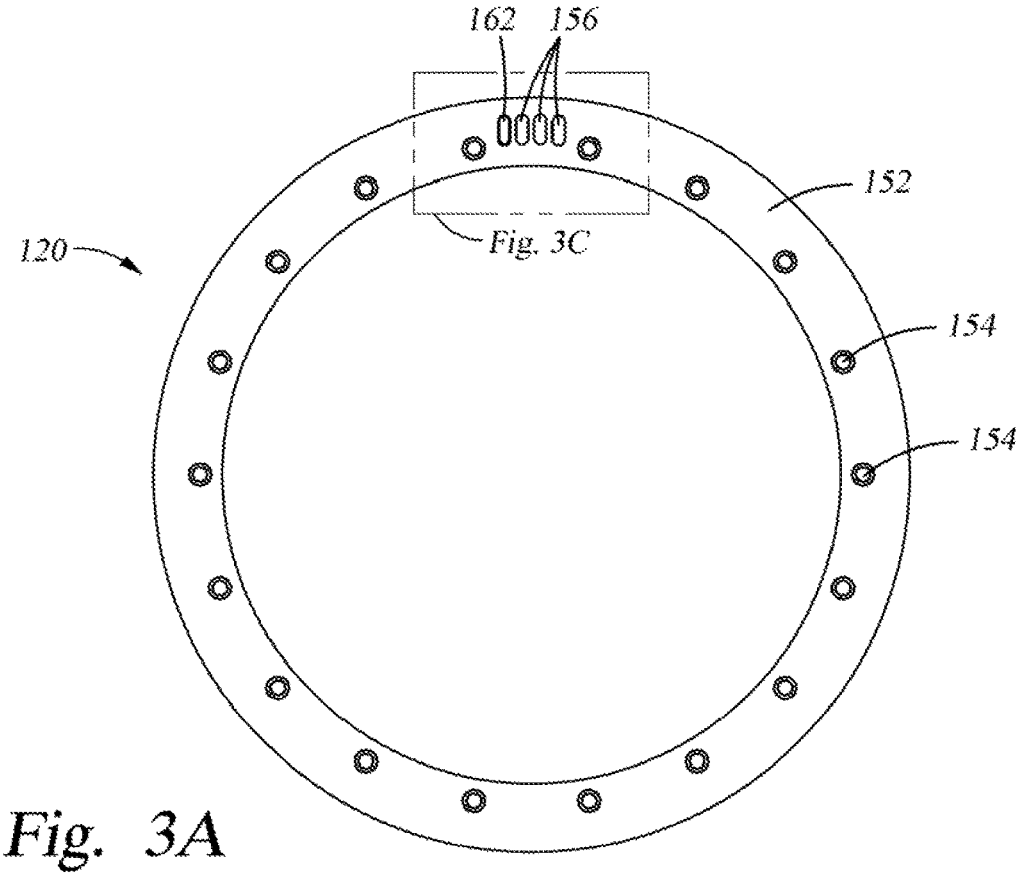
FIG. 3A is a plan view of one embodiment of a retaining ring that may be used in the polishing system of FIG. 1.

FIG. 3A is a plan view of one embodiment of the retaining ring 150 that may be used in the polishing system 100 of FIG. 1. The retaining ring 150 is generally annular ring removably attached and circumscribing the base assembly 124. When fluid is pumped into the loading chamber 128, the base assembly 124 and retaining ring 150 are pushed down to apply a load to the polishing pad 114. In at least one embodiment, the retaining ring 150 may be a one-part ring. In some other embodiments, the retaining ring 150 may be a multi-part ring, for example, comprising upper and lower portions which are coupled together, for example utilizing at least one of adhesives or fasteners.

The retaining ring 150 comprises a top surface 152 having a plurality of blind-holes 154 having internal threads for receiving a plurality of fasteners (e.g., machine screws) to attach the retaining ring 150 to the carrier head 120. The top surface 152 contacts the bottom surface 132 of the carrier head 120 when the retaining ring 150 is installed on the carrier head 120. The top surface 152 can comprise stainless steel, molybdenum, aluminum, other suitable metals, composites, and plastics, among other suitable material. In the example depicted in FIG. 3A, the retaining ring 150 has 18 blind-holes formed in the top surface 152, such that the blind-holes 154 are evenly spaced by a radial angle of 20 degrees. In some other embodiments, the retaining ring 150 may have a lower or higher number of blind-holes 154, and the blind-holes 154 may have uniform or non-uniform spacing. The retaining ring 150 also includes a plurality of alignment slots 156 formed in the top surface 152 for receiving a plurality of alignment pins 136 to align the retaining ring 150 with the carrier head 120. In one example, each alignment slot 156 has a radial orientation relative to a center line of the retaining ring 150. The alignment slots 156 may be configured to engage (i.e., mate with) a limited number of carrier heads 120 to prevent the retaining ring 150 from being installed on the wrong carrier head, that is, a carrier head having a non-complimentary arrangement of alignment pins.

Figure 3B:
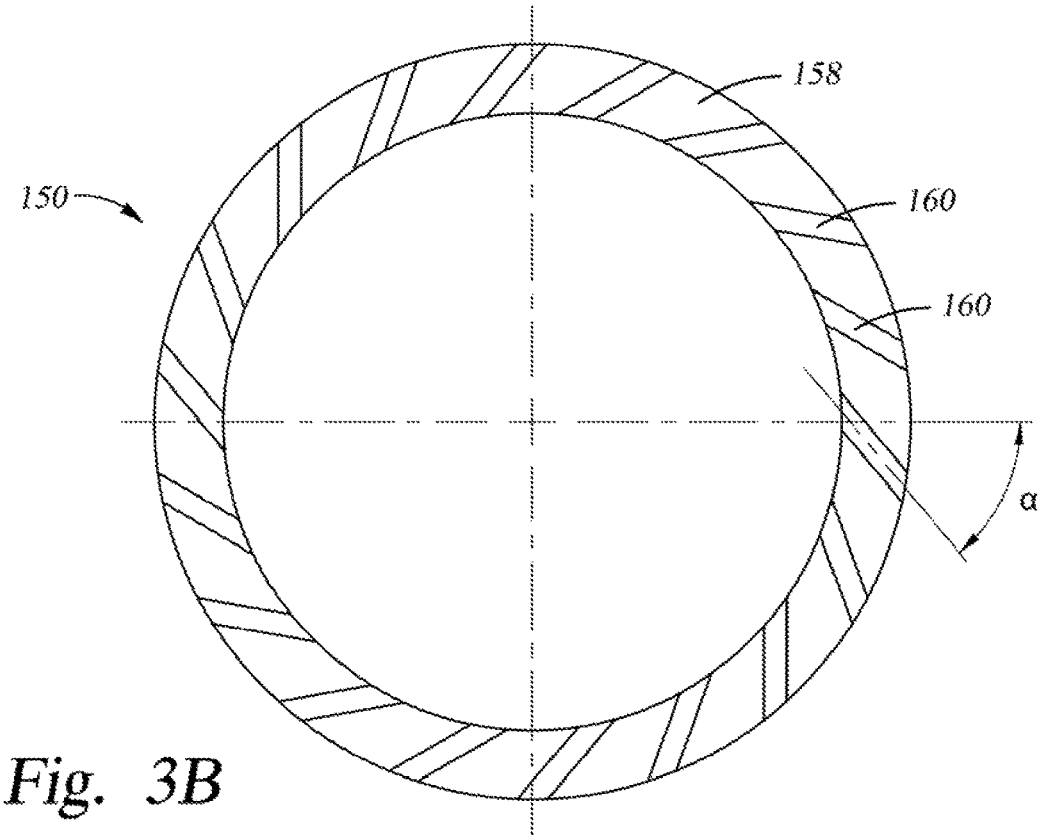
FIG. 3B is a bottom view of one embodiment of a retaining ring that may be used in the polishing system of FIG. 1.

FIG. 3B is a bottom view of one embodiment of the retaining ring 150 that may be used in the polishing system 100 of FIG. 1. The retaining ring 150 has a bottom surface 158 for contacting the polishing pad 114. The bottom surface 158 can comprise polyphenylene sulfide (PPS), polyether ether ketone (PEEK), polyethylene terephthalate (PET), or combinations thereof. In embodiments wherein the retaining ring 150 is a one-part ring, the entire retaining ring 150 comprises the same plastic material exposed on the bottom surface 158 of the retaining ring 150. In some other embodiments as discussed above, the retaining ring 150 may be a two-part ring having upper and lower portions comprising different materials. The retaining ring 150 may comprise a plurality of grooves 160 formed in the bottom surface 158 where the grooves 160 facilitate transport of a polishing composition from outside the retaining ring 150 to the substrate 10. In at least one embodiment, the plurality of grooves 160 may be distributed at equal angular intervals around the retaining ring 150. Each of the plurality of grooves 160 may be oriented at an angle $\alpha$ relative to a radial segment extending through the center of the retaining ring 150. In some embodiments, the angle $\alpha$ may be from about 30° to about 60°, such as about 45°, alternatively about 50°. Therefore, the grooves 160 can transport the polishing composition to and from the substrate 10 even when the bottom surface 158 is contacting the polishing pad 114. In some other embodiments, the bottom surface 158 may be substantially flat without grooves 160.

Figure 3C:
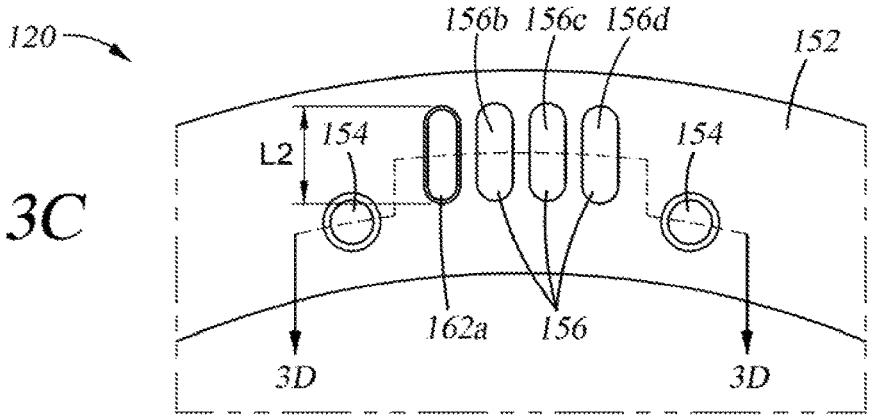
FIG. 3C is an enlarged view of the retaining ring of FIG. 3A showing one embodiment of alignment slots.

FIG. 3C is an enlarged view of the retaining ring 150 of FIG. 3A showing one embodiment of alignment slots 156. Although at least two alignment slots 156 are provided in each retaining ring 150, any desirable number of alignment slots 156 may be utilized as space permits. In one or more embodiments, the alignment slots 156 are elongated in a radial direction relative to the centerline of the retaining ring 150. Referring to the example depicted in FIG. 3C, the retaining ring 150 comprises four alignment slots 156, such as a first alignment slot 156*a* in position 1, a second alignment slot 156*b* in position 2, a third alignment slot 156*c* in position 3, and a fourth alignment slot 156*d* in position 4. The second alignment slot 156*b* is adjacent the first alignment slot 156*a*. The third alignment slot 156*c* is adjacent the second alignment slot 156*b*, where the second alignment slot 156*b* is located between the first and third alignment slots 156*a*, 156*c*. The fourth alignment slot 156*d* is adjacent the third alignment slot 156*c*, where the third alignment slot 156*c* is located between the second and fourth alignment slots 156*b*, 156*d*. In some other embodiments, the retaining ring 150 may have a lower or higher number of alignment slots 156, and the alignment slots 156 may have uniform or non-uniform spacing. In at least one embodiment, the alignment slots 156 may be closed slots (i.e., having closed ends). In some other embodiments, the alignment slots 156 may be open slots (i.e., open to the ID or OD of the retaining ring 150). In some embodiments, the alignment slots 156 may be circular, polygonal, obround, oval, any other suitable shape, or combinations thereof. In some embodiments, the alignment slots 156 may be formed by molding, stamping, machining or other suitable method. In some embodiments, the alignment slots 156 may be grouped between adjacent blind-holes 154. In at least one embodiment, the alignment slots 156 may be grouped within a radial angle of about 20 degrees or less, such as from about 10 degrees to about 20 degrees. In at least one embodiment, the alignment slots 156 may be grouped within a linear distance of about 50 mm or less, such as from about 25 mm to about 50 mm. In at least one embodiment, a second group of alignment slots 156 may be located at a circumferentially opposite side of the retaining ring 150. In some other embodiments, the alignment slots 156 may be distributed circumferentially around the retaining ring 150. In some embodiments, each of the alignment slots 156 and corresponding alignment pins 136 may have a tangential orientation relative to the center line of the retaining ring 150, that is, where each of the alignment slots 156 and corresponding alignment pins 136 are aligned perpendicularly to a radial axis through the centerline of the retaining ring 150. In some other embodiments, the alignment slots 156 and corresponding alignment pins 136 may be positioned in a grid pattern or another suitable layout.

Each of the alignment slots 156 is configured to receive an insert 162. Certain slots 156 are selected to receive inserts 162 to create a mating feature of a particular type of retaining ring 150 that is complimentary to the mating features of the carrier head 120, so that only specific rings 150 and heads 120 maybe paired in accordance with predefined processes to be performed on the polishing system 100. In the example depicted in FIG. 3C, a first insert 162*a* in position 1 is disposed in the respective first alignment slot 156*a*. The insert 162*a* prevents insertion of an alignment pin 136 into the first alignment slot 156*a*. The inserts 162 are formed of a material which is inert to chemicals utilized in a CMP process. The inserts 162 may also be formed of a material that is heat resistant. In at least one embodiment, the inserts 162 are fabricated from a metal or polymer. Suitable polymers include PPS, PEEK, PET, polytetrafluoroethylene (PTFE), polyvinyl chloride (PVC), polypropylene (PP), polyethylene (PE), polycarbonate (PC), poly(methyl methacrylate) (PMMA), polyoxymethylene (POM), acrylonitrile butadiene styrene (ABS), polybutylene terephthalate (PBT), and polyetherimide (PEI), among others. In FIG. 3C, the second alignment slot 156*b*, the third alignment slot 156*c*, and the fourth alignment slot 156*d* in position 2, position 3, and position 4, respectively, are open to allow insertion of the first alignment pin 136*b*, the second alignment pin 136*c*, and the third alignment pin 136*d*, respectively.

Figure 3D:
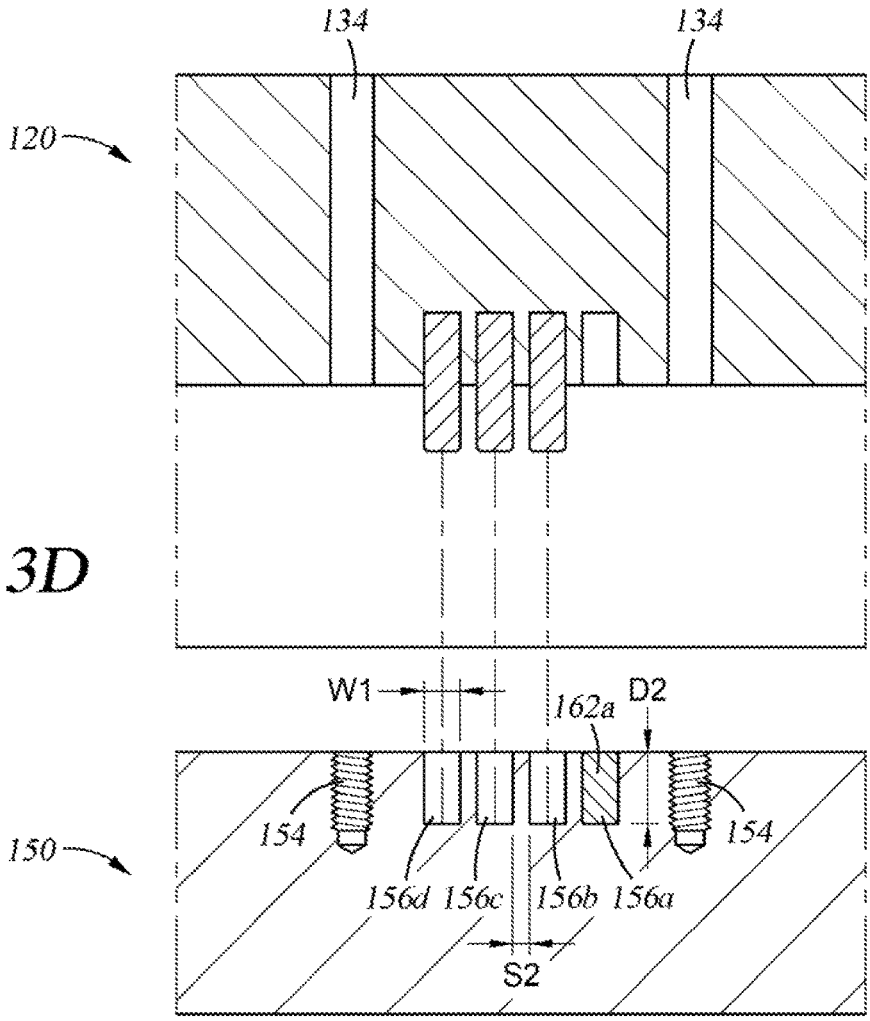
FIG. 3D is a sectional view taken along section line 3D-3D of FIG. 3C showing one embodiment of alignment slots.

FIG. 3D is a section view along line 3D-3D of FIG. 3C showing one embodiment of alignment slots 156. The alignment slots 156 may be positioned to correspond to the respective alignment pins 136 extending from the carrier head 120. Likewise, the alignment slots 156 may be sized and shaped to receive the respective alignment pins 136. In at least one embodiment, the alignment slots 156 correspond exactly to the alignment pins 136. In other words, there are an equal number of alignment slots 156 and alignment pins 136, so that each alignment slot 156 is occupied by a respective alignment pin 136 when the retaining ring 150 is installed on the carrier head 120. The alignment slots 156 may have a depth D2 suitable to receive the alignment pins 136. In at least one embodiment, the depth D2 may be about 10 mm or less, such as from about 2 mm to about 10 mm, such as from about 4 mm to about 6 mm. Adjacent alignment slots 156, such as first and second alignment slots 156*a-b*, may be spaced by a distance S2 of about 2 mm or more, such as from about 2 mm to about 10 mm, such as from about 4 mm to about 5 mm. The alignment slots 156 may have a length L2 greater than or about equal to the diameter DIA1 of the alignment pins 136, such as from about 1× the diameter DIA1 to about 3× the diameter DIA1. In at least one embodiment, the length L2 may be about 3 mm or more, such as from about 3 mm to about 18 mm. The alignment slots 156 may have a width W1 suitable to receive the alignment pins 136 with a total unilateral tolerance of about +1 mm or less. In at least one embodiment, the width W1 may be from about 3 mm to about 7 mm.

Figure 3E:
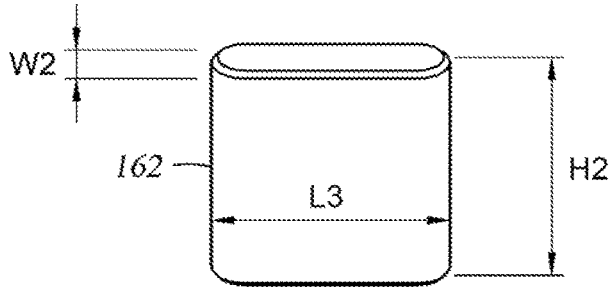
FIG. 3E is a perspective view of one embodiment of an insert that may be used in the retaining ring of FIG. 3A.

FIG. 3E is a perspective view of one embodiment of the insert 162 that may be used in the retaining ring 150 of FIG. 3A. The insert 162 may have a length L3, a width W2, and a height H2 suitable to be disposed into the alignment slot 156 without protruding above the top surface 152 of the retaining ring 150. In one example, the insert 162 is sized to press-fit into the alignment slot 156. In other examples, the insert 162 may be retained in the alignment slot 156 using adhesives, staking, or via another suitable technique. The size and shape of each alignment slot 156 is the same so that any one insert 162 may fit in any one of the alignment slots 156. In at least one embodiment, a top surface 164 of the insert 162 may be about flush with the top surface 152. In some embodiments, the top surface 164 may be recessed relative to the top surface 152.

Figure 4A:
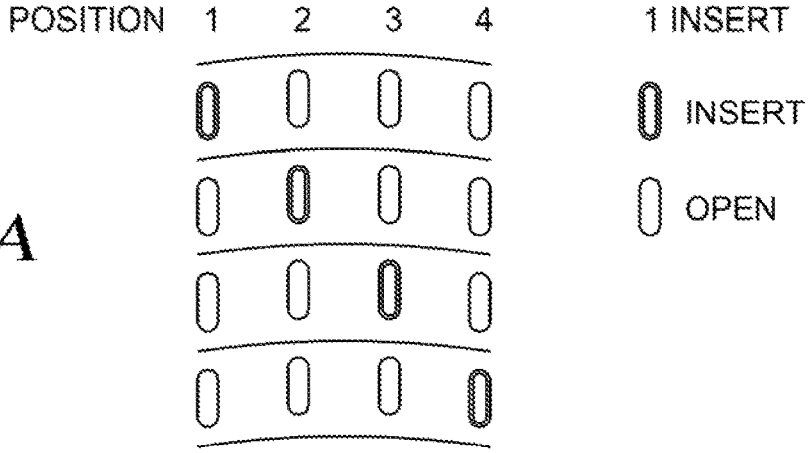
FIG. 4A is a schematic illustration of various combinations of inserts and open alignment slots that may be utilized to differentiate between different types of retaining rings.
Figure 4B:
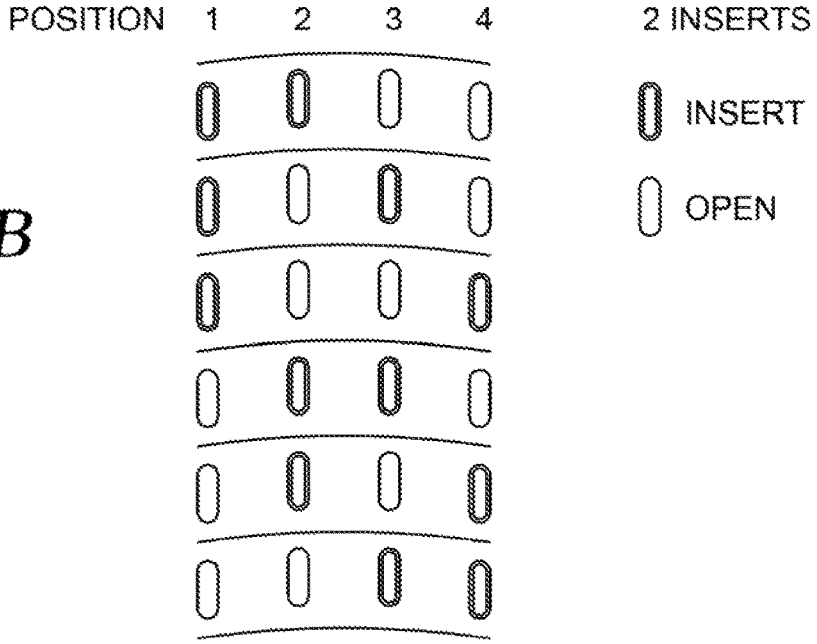
FIG. 4B is another schematic illustration of various combinations of inserts and open alignment slots that may be utilized to differentiate between different types of retaining rings.
Figure 4C:
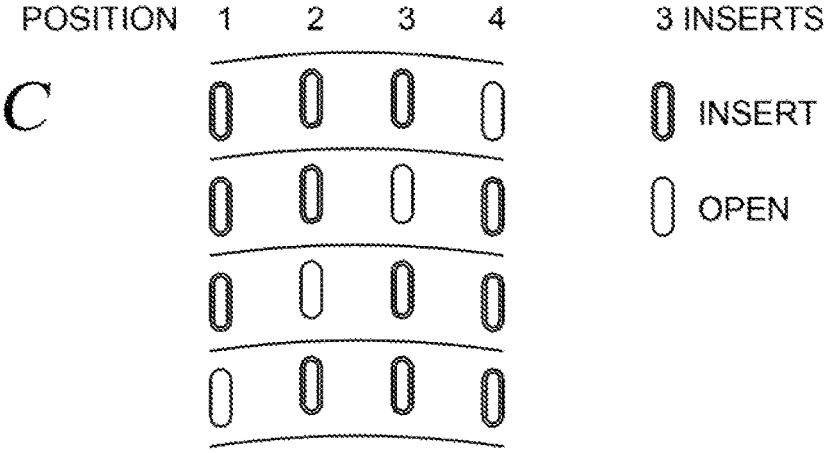
FIG. 4C is yet another schematic illustration of various combinations of inserts and open alignment slots that may be utilized to differentiate between different types of retaining rings.

In some embodiments, each different type of retaining ring 150 has a different and unique combination of inserts 162 and open alignment slots 156 relative to the other types of retaining rings 150 to prevent the retaining ring 150 from being installed on the wrong carrier head, i.e., a carrier head not having complimentary mating features. In some embodiments, the retaining ring 150 has at least one insert 162. In such embodiments, a total number of different combinations is equal to $2^{slots}$-2. For example, the retaining ring 150 in FIG. 3A has four alignment slots 156, so the total number of different combinations of inserts 162 is equal to 14, as shown in FIGS. 4A-4C. It will be appreciated that a greater number of combinations may be generated by introducing one or more additional alignment slots 156 to use with carrier heads having additional pin locations. For example, with five alignment slots 156, the total number of different combinations of inserts 162 is equal to 30. It will further be appreciated that the retaining 150 may have fewer alignment slots 156 when fewer combinations are needed. For example, with three alignment slots 156, the total number of different combinations of inserts 162 is equal to 6.

FIG. 4A is a schematic illustration of various combinations of inserts 162 and open alignment slots 156 that may be utilized to differentiate between different types of retaining rings 150. In FIG. 4A, each row of inserts 162 and open alignment slots 156 is representative of a different retaining ring 150. In the first row representing a first retaining ring, only position 1 has an insert, and positions 2, 3, and 4 are open. In the second row representing a second retaining ring, only position 2 has an insert, and positions 1, 3, and 4 are open. In the third row representing a third retaining ring, only position 3 has an insert, and positions 1, 2, and 4 are open. In the fourth row representing a fourth retaining ring, only position 4 has an insert and positions 1, 2, and 3 are open.

FIG. 4B is another schematic illustration of various combinations of inserts 162 and open alignment slots 156 that may be utilized to differentiate between different types of retaining rings 150. In FIG. 4B, each row of inserts 162 and open alignment slots 156 is representative of a different retaining ring 150. In the first row representing a first retaining ring, only positions 1 and 2 have inserts, and positions 3 and 4 are open. In the second row representing a second retaining ring, only positions 1 and 3 have inserts, and positions 2 and 4 are open. In the third row representing a third retaining ring, only positions 1 and 4 have inserts, and positions 2 and 3 are open. In the fourth row representing a fourth retaining ring, only positions 2 and 3 have inserts, and positions 1 and 4 are open. In the fifth row representing a fifth retaining ring, only positions 2 and 4 have inserts, and positions 1 and 3 are open. In the sixth row representing a sixth retaining ring, only positions 3 and 4 have inserts, and positions 1 and 2 are open.

FIG. 4C is yet another schematic illustration of various combinations of inserts 162 and open alignment slots 156 that may be utilized to differentiate between different types of retaining rings 150. In FIG. 4C, each row of inserts 162 and open alignment slots 156 is representative of a different retaining ring 150. In the first row representing a first retaining ring, only positions 1, 2, and 3 have inserts, and position 4 is open. In the second row representing a second retaining ring, only positions 1, 2, and 4 have inserts, and position 3 is open. In the third row representing a third retaining ring, only positions 1, 3, and 4 have inserts, and position 2 is open. In the fourth row representing a fourth retaining ring, only positions 2, 3, and 4 have inserts, and position 1 is open.

While the foregoing is directed to embodiments of the present disclosure, other and further embodiments of the disclosure may be devised without departing from the basic scope thereof, and the scope thereof is determined by the claims that follow.

What is claimed is:

1. A retaining ring, comprising:

a bottom surface configured to contact a polishing pad; and a top surface configured to attach to a carrier head, wherein the top surface includes:

a plurality of threaded screw holes;

a plurality of alignment slots each configured to accept an alignment pin; and a first insert disposed in a first alignment slot of the plurality of alignment slots, the first insert flush with or below the top surface, the first insert configured to prevent insertion of the alignment pin into the first alignment slot.

2. The retaining ring of claim 1, wherein the plurality of alignment slots are located between first and second adjacent threaded screw holes of the plurality of threaded screw holes.

3. The retaining ring of claim 1, wherein the plurality of alignment slots are located within a radial angle of about 20 degrees.

4. The retaining ring of claim 1, wherein each of the alignment slots is radially aligned with a centerline of the retaining ring.

5. The retaining ring of claim 1, wherein the top surface comprises a metal and the insert comprises a polymer.

6. The retaining ring of claim 1, wherein each of the plurality of alignment slots has a shape selected from the group consisting of circular, obround, and oval.

7. The retaining ring of claim 1, wherein at least one alignment slot is open to allow insertion of the alignment pin.

8. The retaining ring of claim 1, wherein the first insert is configured to be disposed in any of the alignment slots.

9. The retaining ring of claim 1, wherein the plurality of alignment slots further comprises:

a second alignment slot;

a third alignment slot; and a fourth alignment slot.

10. The retaining ring of claim 9, wherein the second, third and fourth alignment slots are open and disposed on the same side of the first alignment slot, and wherein the first, second, third and fourth alignment slots are disposed between adjacent threaded screw holes.

11. The retaining ring of claim 9, wherein the first alignment slot is disposed between the second and third alignment slots, and the third and fourth alignment slots are open and disposed on the same side of the first alignment slot, and wherein the first, second, third and fourth alignment slots are disposed between adjacent threaded screw holes.

12. The retaining ring of claim 9 further comprising:

a second insert disposed in the second alignment slot.

13. The retaining ring of claim 12, wherein the first and second alignment slots are disposed next to each other and the third and fourth alignment slots are open.

14. The retaining ring of claim 12, wherein the first and second alignment slots are separated by at least one of the third and fourth alignment slots, and wherein the third and fourth alignment slots are open.

15. The retaining ring of claim 9 further comprising:

a second insert disposed in the second alignment slot; and a third insert disposed in the third alignment slot.

16. The retaining ring of claim 15, wherein the first, second and third alignment slots are disposed next to each other and the fourth alignment slot is open.

17. The retaining ring of claim 15, wherein the fourth alignment slot is open and is disposed between two of the first, second and third alignment slots.

18. The retaining ring of claim 9 further comprising:

a second insert disposed in the second alignment slot;

a third insert disposed in the third alignment slot; and a fourth insert disposed in the fourth alignment slot.

19. A polishing system, comprising:

the retaining ring of claim 1; and a carrier head having a bottom surface contacting the top surface of the retaining ring, wherein the carrier head includes at least one of the alignment pins extending from the bottom surface into an open one of the plurality of alignment slots.

20. The polishing system of claim 19, wherein a number of apertures is greater than a number of the alignment pins.

* * * * *